US007121076B2

(12) United States Patent
Priegelmeir et al.

(10) Patent No.: US 7,121,076 B2
(45) Date of Patent: Oct. 17, 2006

(54) FLYER BOW FOR WIRE BUNCHING OR WIRE STRANDING MACHINES

(75) Inventors: Walter Priegelmeir, Bäumenheim (DE); Richard Strauss, Westendorf (DE); Sven Schweizer, Augsburg (DE)

(73) Assignee: SGL Carbon AG, Wiesbaden (DE)

( * ) Notice: Subject to any disclaimer, the term of this patent is extended or adjusted under 35 U.S.C. 154(b) by 0 days.

(21) Appl. No.: 11/172,020

(22) Filed: Jun. 29, 2005

(65) Prior Publication Data

US 2006/0000198 A1 Jan. 5, 2006

(30) Foreign Application Priority Data

Jun. 29, 2004 (EP) ..... 04015191

(51) Int. Cl.
*D01H 7/38* (2006.01)

(52) U.S. Cl. ..... 57/118

(58) Field of Classification Search ..... 57/115–118, 57/58.63

See application file for complete search history.

(56) References Cited

U.S. PATENT DOCUMENTS 3,793,819 A * 2/1974 Madalozzo et al. ..... 57/58.52
5,509,260 A * 4/1996 Derdeyn ..... 57/58.83
5,809,763 A 9/1998 Rowlands et al.
6,223,513 B1 5/2001 Post et al.
6,289,661 B1 9/2001 Boland
2004/0172932 A1 * 9/2004 Watkins ..... 57/67

FOREIGN PATENT DOCUMENTS

| | | | |
|---|---|---|---|
| CH | 618 486 | A5 | 7/1980 |
| DE | 199 38 127 | A1 | 2/2001 |
| EP | 0 525 856 | A1 | 2/1993 |
| EP | 569730 | A1 * | 11/1993 |
| JP | 05247861 | A * | 9/1993 |
| WO | 2004/011354 | A1 | 2/2004 |

* cited by examiner

*Primary Examiner*—Shaun R. Hurley
(74) *Attorney, Agent, or Firm*—Laurence A. Greenberg; Werner H. Stemer; Ralph E. Locher

(57) ABSTRACT

A flyer bow for wire bunching or wire stranding machines has an inner flank on which is introduced longitudinally and centrally a tube which is formed of a wear-resistant material and which acts as an integrated wire guide. This results in the flyer bow having a compact construction, uniform wire guidance and an easy exchangeability of the parts subjected to wear due to the friction of the wires.

18 Claims, 3 Drawing Sheets

FLYER BOW FOR WIRE BUNCHING OR WIRE STRANDING MACHINES

BACKGROUND OF THE INVENTION

Field of the Invention

The invention relates to a flyer bow for wire bunching or wire stranding machines.

In such machines known from the prior art, the separate wire strings provided on individual reels are first combined, so that a bundle formed of a plurality of parallel wires is obtained. The bundle of parallel wires is then drawn along the inner flank of a bow (flyer bow) rotating about a horizontally or vertically disposed axis. As a result of the rotation of the bow, the originally parallel wires are twisted with one another when they run in onto the bow and are twisted with one another a further time when they run off from the bow. The twisted wire running off from the bow is wound onto a reel. For productivity reasons, it is desirable to operate at as high a rotational speed as possible. The flyer bows in this case are exposed to higher load owing to centrifugal force, on the one hand, and owing to the friction of the wire, on the other hand, since during rotation, the centrifugal force causes the wire string to be pressed against the inner flank of the bow according to a rope trajectory characteristic curve.

It is known to manufacture flyer bows for the machines described above from plastics reinforced with carbon fibers or with glass fibers (CFRP or GFRP). Bows with a rectangular profile were originally used. To reduce the air resistance during rotation, however, streamlined (aerodynamic) profiles were developed. For guiding the wires along the curvature of the bow, a guide channel or guide groove lined with a metal sheet acting as wear protection, preferably made from a largely abrasion-resistant hard metal, is incorporated into the surface of the inner flank of the flyer bow, and a plurality of wire guide eyes are formed so as to be distributed over the length of the wire guide groove. Conventionally, these eyes are screwed into the flyer bow. Wire guidance via eyes according to the prior art has some significant disadvantage. Thus, the eyes projecting out of the inner flank of the flyer bow disturb the aerodynamic shape of the flyer bow, thus leading to an increase in the air resistance during rotation. The exchange of worn eyes is relatively time consuming, and the bores necessary for screwing in the eyes constitute mechanical weak points over the flyer bow. To overcome this disadvantage, U.S. Pat. No. 6,289,661 proposes configuring the eyes for the wire guidance in such a way that they are plugged onto the flyer bow and surround the latter laterally. According to U.S. Pat. No. 5,809,763, a further improvement involves using, instead of semicircular eyes, eyes with a flattened circumference that are better adapted to the streamlines profile of the flyer bow.

Alternative solutions for the wire guidance were also proposed. For example, U.S. Pat. No. 6,223,513 discloses a flyer bow with a profile in the form of an airfoil. This has passing through it an inner duct provided with a sprung wire guide. The duct is surrounded by the inner and the outer flank of the bow (as seen in relation to the axis of rotation) and is in contact with the surrounding air via a plurality of bores that traverse the inner and the outer flank of the bow. During the rotation of the flyer bow, a pressure difference is formed between its inner flank and its outer flank, and therefore an air stream flows from the inner flank, at which the pressure is higher, through the bores on the inner flank into the wire guide duct and out again through the bores on the outer flank. The material abrasion occurring in the wire guide duct is thereby to be transported away. The problem with this variant of flyer bows is the relatively complicated shaping with the duct that lies inside. Such a flyer bow may be produced from two parts that surround the wire guide duct and are connected to one another, but the connecting seam then constitutes a potential weak point. By contrast, if the flyer bow is to be produced in one piece, relatively complicated forming (dies) molds with space savers for the wire duct lying inside the work piece are required.

European patent EP 0 525 856 B1 likewise discloses a flyer bow with a profile in the form of an airfoil. The flyer bow is formed of an inner core of a rectangular profile made from a load-bearing material, for example carbon fibers, and of a sheath extruded over the core and formed of a synthetic material that does not necessarily have to be load-bearing. The sheath is configured such that it gives the bow a profile in the form of an airfoil. The wire is led through a groove which is introduced into the core surface facing the axis of rotation and is coated with hard metal and which is covered by the sheath surrounding the core. Preferably, in the sheath region covering the wire guide groove, a plurality of holes are provided in order to make it easier to introduce the wire. In a first embodiment, the sheathing lies sealingly and firmly on the surface of the core. However, a second embodiment is also disclosed which is to allow a rapid exchange of the sheath. This variant, not described in any more detail, is configured, according to FIG. 2 of the European patent, in such a way that the sheath is wider than the dimensions of the core of rectangular profile, so that the inside of the sheath does not lie over its area on the core, but touches it linearly at the edges only. In this form of construction with a lower mass, the sheath can safely be detached from the core easily, for example by the sheath being cut open lengthways and simply being stripped off from the core laterally. After this, however, a new sheath has to be extruded over the core, and, because of the devices necessary for this purpose, inter alia, this cannot take place on the spot on the premises of the wire manufacturer or wire processor. Consequently, in this variant, too, the replacement of worn sheathings or the renewal of the hard metal coating of the wire guide groove seems to be relatively complicated.

International patent disclosure WO 2004/011354 discloses a flyer bow that allows for a reduction in the frictional force between the bow and the wire running over it and a reduction in the stress acting on the wire. This is achieved in that the wire is transported via an endless conveyor belt moved by a drive device. The conveyor belt moves along the inner flank of the flyer bow in the wire running direction, is deflected at the front end of the flyer bow, as seen in the wire running direction, onto the outer flank of the flyer bow via a roller, runs back along the outer flank of the flyer bow and there is deflected again to the inner flank of the flyer bow via a further roller. The conveyor belt is guided along the outer flank of the flyer bow by eyes and along the inner flank by an incorporated duct that is provided with a cover. The speed of the conveyor belt is adapted to the speed of the wire running over the flyer bow, so that friction between wire and conveyor belt is avoided and wire stress is reduced. However, a relatively complicated construction of the device and, during operation, an additional effort in terms of regulation for synchronizing the rotational speed of the conveyor belt with the wire running speed militate against this major advantage.

SUMMARY OF THE INVENTION

It is accordingly an object of the invention to provide a flyer bow for wire bunching or wire stranding machines which overcomes the above-mentioned disadvantages of the prior art devices of this general type. One object on which the present invention is based is to provide a flyer bow with an integrated wire guide which allows uniform wire guidance, only slightly influences the shape of the bow, and permits an easy and rapid exchange of the components subjected to wear by the wires.

With the foregoing and other objects in view there is provided, in accordance with the invention, a flyer bow for a wire bunching or wire stranding machine. The flyer bow contains a flyer bow body having an inner flank, and a longitudinally running wire guide tube formed of a wear-resistant material disposed centrally on the inner flank of the flyer bow body with respect to an axis of rotation.

The object is achieved, according to the invention, in that the tube formed of a wear-resistant material and serves as an integrated wire guide is introduced on the inner flank of the flyer bow.

In accordance with an added feature of the invention, the flyer bow body is formed of a plastic reinforced with glass fibers, carbon fibers, or a mixed composition of carbon fibers and glass fibers. The wire guide tube is formed of metal, plastic, a plastically deformable material or an elastically deformable material. Preferably, the wire guide tube is a plastic hose, formed of a transparent material, and/or has an inside diameter of between 1.5 and 28 mm.

In accordance with another feature of the invention, the flyer bow body has a profile in the form of an airfoil, a rectangle with rounded corners or of a flattened octagon.

In accordance with a further feature of the invention, the flyer bow body has a profile such that the inner flank with respect to the axis of rotation has a convex curvature and an outer flank that is flat, a transition region between the inner flank and the outer flank being rounded. Preferably, the inner flank has formed in it centrally, for receiving the wire guide tube, a longitudinal groove, the longitudinal groove having a width with an undersize with respect to outer dimensions of the wire guide tube to be introduced into the longitudinal groove. Ideally, the longitudinal groove has a U-shaped cross section.

In accordance with a concomitant feature of the invention, the inner flank has formed therein centrally, for receiving the wire guide tube, a longitudinal groove defined by groove walls. The longitudinal groove has a cross section in a form of a circle which is truncated by a chord defining a truncated circle. The longitudinal groove has a diameter corresponding to an outside diameter of the wire guide tube to be inserted. The truncated circle has an arc covering an angle of between 180.1 and 240°, and a straight truncation line forming an orifice of the longitudinal groove, so that the wire guide tube, after insertion, has engaged behind it the groove walls projecting toward the orifice.

Other features which are considered as characteristic for the invention are set forth in the appended claims.

Although the invention is illustrated and described herein as embodied in a flyer bow for wire bunching or wire stranding machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1G:
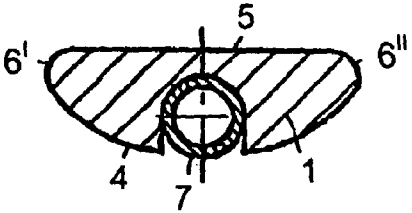
FIGS. 1A–1H are diagrammatic, sectional views of various profile configurations of a flyer bow according to the invention with an introduced wire guide tube.
Figure 1E:
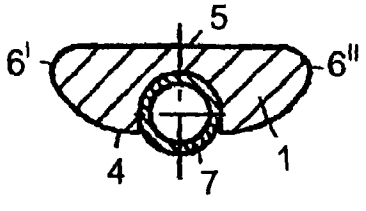

Referring now to the figures of the drawing in detail and first, particularly, to FIGS. 1A–1H thereof, there is shown a body of a flyer bow according to the invention that is manufactured, for example, from plastic reinforced with carbon fibers or with glass fibers. Flyer bow bodies with a mixed construction formed of both materials are also known. A longitudinally running groove for receiving a wire guide tube is introduced centrally on an inner flank of the bow, which is to say on the flank facing an axis of rotation. A pipe, for example a metal pipe, inserted into the groove or a hose, for example a transparent plastic hose, clamped into the groove serves as a wire guide tube. The inside diameter of the wire guide tube is expediently 1.5 to 28 mm.

Wire guidance according to the invention by a tube is not tied to a specific flyer bow profile. Various aspects are to be taken into account in the configuration of the profile of the flyer bow, such as air resistance, the minimum thickness necessary for the strength of the material, the centrifugal forces occurring during rotation, the embedding of the wire guide tube into the inner flank of the flyer bow and a fault-free wire guidance during rotation.

By forming the profile as an airfoil, known from the prior art, the air resistance can be minimized and therefore drive energy for rotation can be saved. If the type of wire guidance according to the invention by use of a wire guide tube is to be combined with a bow profile in the form of an airfoil, the groove to be provided for receiving the wire guide tube on the inner flank of the bow must expediently be configured such that the wire guide tube is largely countersunk in the bow surface, so as not to impair the aerodynamically optimized profile of the bow.

The inventors found, however, that the strong lift formed during the rotation on flyer bows in the form of an airfoil causes considerable load on the bearings in which the flyer bow is fastened at its ends. It is therefore desirable, in configuring the profile of the flyer bow, to reach a compromise between air resistance and bearing load.

FIGS. 1A–1H illustrates by way of example some profiles of the flyer bow body 1 that are preferred for the present invention. The profiles shown in FIGS. 1A and 1B may be considered as a further development of the rectangular profile used earlier, the corners of the rectangle having been rounded in order to reduce air resistance. These roundings are identified in FIGS. 1A and 1B as 2', 2", 2'", 2"".

Figure 1C:
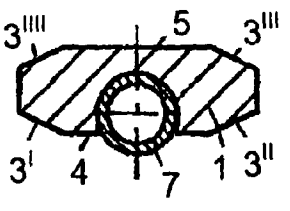
Figure 1A:
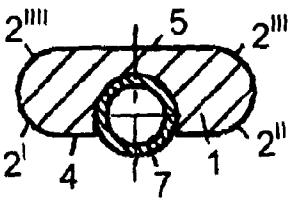
Figure 1H:
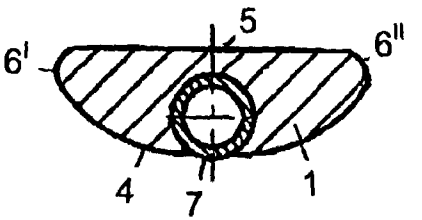
Figure 1F:
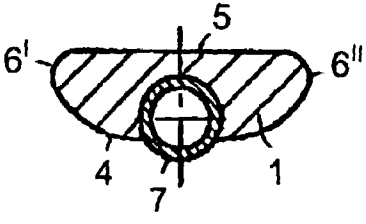
Figure 1D:
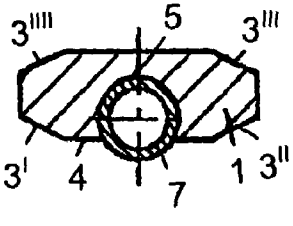

In a further variant, the corners of the rectangle are beveled, so that a profile as shown in FIG. 1C or 1D corresponding to a flattened octagon is obtained. The bevels are identified in the profiles shown in FIGS. 1C and 1D as 3', 3", 3'", 3 "".

A wire guide tube 7 is introduced in each case centrally in an inner flank 4 of the flyer bow 1 that is to say the flank 4 facing the axis of rotation.

However, the profiles shown in FIGS. 1E to 1H have proved particularly advantageous, of which the flank 4 oriented toward the axis of rotation has a convex curvature, while the outer-facing flank 5 is flattened. The transition areas 6' and 6" between the curved inner flank 4 and the flattened outer flank 5 are rounded in order to reduce air resistance. On profiles of this type, in contrast to the profile in the form of an airfoil according to the prior art, a negative lift is established which reduces the action of the centrifugal forces. As a result, the load on the bearings is reduced, and their useful life is increased. The profiles shown in FIGS. 1G and 1H are particularly preferred because, here, the wire guide tube 7 is countersunk virtually completely in the inner flank 4 and therefore, in contrast to the wire guide tube 7 in variants shown in FIGS. 1E and 1F which projects out of the surface of the inner flank 4, scarcely impair the aerodynamic behavior of the bow.

In contrast to the profile in the form of an airfoil, a symmetrical profile of the flyer bow according to the variants shown in FIGS. 1A–1H is also advantageous because its orientation during installation into the machine is independent of the direction of rotation. Mounting errors can thus be avoided.

A longitudinally running groove is provided centrally on the inner flank 4 of the flyer bow in order to receive the wire guide tube 7. A groove may be provided which extends over the entire length of the bow inner flank 4 and which issues at the ends of the bow, on end faces of the latter, in each case in an open cross section. In another variant, the groove is configured in such a way that it is flattened towards the ends of the bow to a level with the surface of the bow inner flank 4, so that the inserted wire guide tube 7 emerges onto the surface of the bow inner flank 4 at the flattened ends of the groove. The emerging tube ends are cut off, so that the tube issues are flush with the surface of the inner flank 4.

The cross section of the groove is configured such that the wire guide tube 7, on the one hand, can easily be introduced into the groove and as far as possible also removed again, but, on the other hand, is retained reliably during the rotation process. This can be achieved in various ways. For example, the groove may be configured in such a way that its width W has a slight undersize in relation to the outer dimensions of the pipe or hose to be inserted. When being pressed into the groove, the pipe or hose is compressed slightly. In the inserted state, the pipe or hose completely fills the space available in the groove, in turn presses against the wall of the groove and is thereby retained. Alternatively, the groove may be designed in such a way that its orifice is narrower than the outside diameter of the pipe to be inserted, but the groove cross section widens away from the orifice to an extent such that said groove cross section can receive the wire guide tube. In this arrangement, the wire guide tube has engaged behind it the groove cross section narrowing toward the orifice and is thus retained in the groove.

Figure 1B:
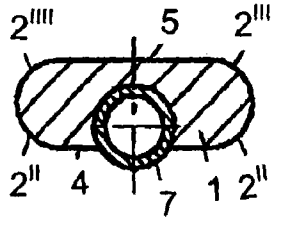
Figure 2A:
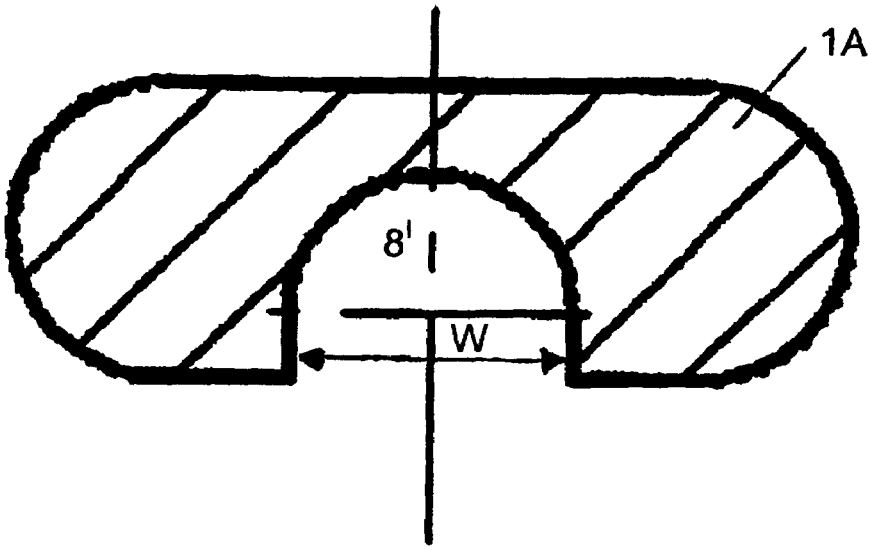
FIGS. 2A and 2B are diagrammatic, sectional views showing various configurations of a cross section of a groove receiving the wire guide tube on an illustrative bow profile.
Figure 2B:
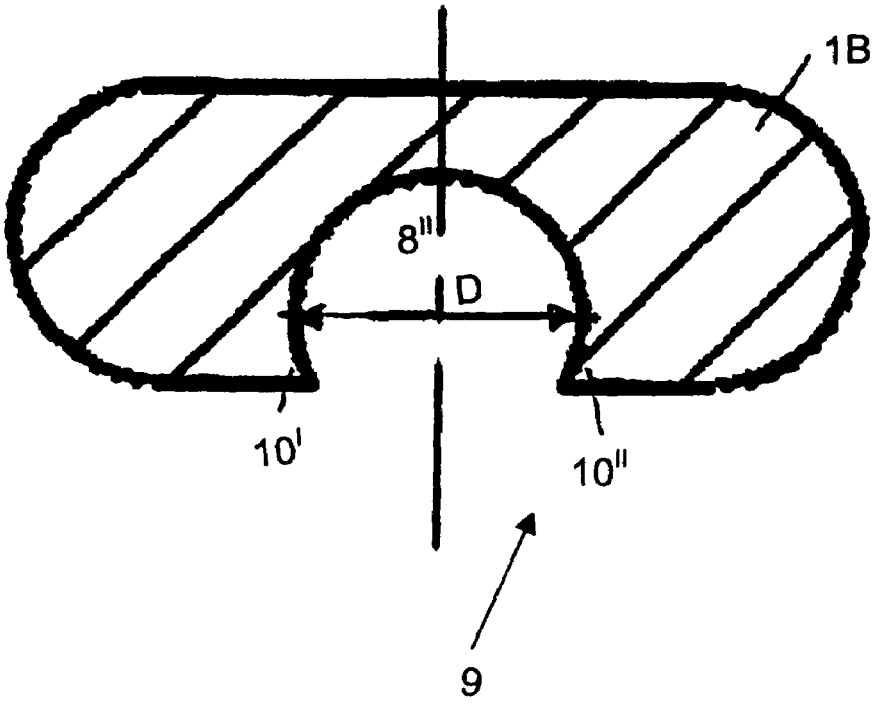

FIGS. 2A and 2B illustrate by way of example, for the flyer bow profiles of FIGS. 1A and 1B, two configurations 8' and 8" of the groove provided for receiving the wire guide tube 7. It may be pointed out, however, that the groove cross sections are not tied to this bow profile, but these groove cross sections can rather be combined with any desired bow profiles.

In FIG. 2A, the groove 8' with a U-shaped cross section is provided, the width W of which is smaller than the outer dimensions of the pipe or hose in the nonpressed-in state. The cross section of the pipe or hose to be inserted into the U-shaped groove 8' may be circular or oval, what is critical being that its outer dimensions are larger than the width W of the groove and that the pipe or hose is deformable to an extent that it can be pressed into the groove and adapt to the dimensions of the latter.

In another variant, according to FIG. 2B, the groove 8" with a cross section in the form of a truncated circle is provided, the diameter D of the circle corresponding to the outside diameter of the pipe to be received. The term "truncated circle" is understood, here, to mean the larger of the two parts of the circle that has been cut into two parts by a chord. Such a structure is delimited, on the one hand, by the straight line of the truncation and, on the other hand, by a circle arc which covers an angle of more than 180°. An orifice 9 of the groove 8" is formed by the straight truncation of the circle and is consequently narrower than the diameter D of the circle. Preferably, the groove 8" is configured in such a way that the circle arc describes an angle of between 180.1° and 240°. The orifice 9 of the groove 8" is narrower than the diameter D of the circle arc and is consequently also narrower than the outside diameter of the pipe to be inserted. However, the cross section of the groove widens away from the orifice 9 up to the outside diameter of the wire guide tube to be received.

The wire guide tube, formed of a slightly elastic material, is pressed, with narrowing, through the narrow orifice 9 into the groove 8", as it were snapped in, but then widens again to its original diameter, so that it completely fills the groove and sealingly adjoins the wall of the latter. If the "snapping" into the groove is not possible because of a lack of elasticity of the pipe or hose material, the wire guide tube is slipped or pushed from one end of the bow into the open end (the issue) of the groove and is then drawn lengthways into the groove by a suitable guide tool.

The inserted wire guide tube has engaged behind it the groove walls 10', 10" projecting toward the orifice and is thereby retained in the groove.

A particular advantage of the invention is the relatively easy exchangeability of the wire guide tube subjected to wear. This may take place in various ways, depending on the configuration of the groove and the handling of the hose or pipe material.

For example, the hose may be gripped around, on its wall projecting from the groove, by a suitable tool, for example pliers, and be compressed to a thickness that is smaller than the width of the groove, so that it can be removed from the groove. In another variant, a suitable lever tool is introduced between the wire guide tube and groove wall, this tool engages under the wire guide tube and the latter is lifted out of the groove.

Less easily deformable hoses or pipes or wire guide tubes countersunk very deeply in the bow surface can be pulled out lengthways through one of the open ends of the groove by a suitable tool which is introduced into the issue of the tube and which acts on the inner wall of the latter.

The essential criterion for selecting the material of the wire guide tube is wear resistance. It was shown that, in addition to pipes made from metallic materials, hoses made from various plastics also have sufficient wear resistance for use as a wire guide tube.

Preferably, the wire guide tubes used are hoses or tubes made from materials which have slight plastic or elastic deformability and, utilizing this deformability, can be introduced into a groove which has a slight undersize in relation to the outer dimensions of the wire guide tube to be inserted or into an orifice which is narrower than the outside diameter of the wire guide tube. Particularly suitable for this purpose are flexible houses, the cross section of which is deformable and can thus be adapted to the surrounding groove wall. Suitable hoses formed, for example, of plastic materials are available commercially from a very wide range of manufacturers.

Furthermore, the wire guide tube is preferably formed from a transparent material, for example a transparent wear-resistant plastic. The transparent version of the wire guide tube makes it easier to check the process flow and locate faults in the event of disturbances. Suitable materials for producing transparent tubes of this type are, for example, polyethylene, polypropylene, polyoxymethylene and polyurethane.

Alternatively, tubes made from metal may be used, the advantage of which is a higher abrasion resistance and therefore a longer operating time.

The benefits of the flyer bow according to the invention, as compared with the prior art, are the compact configuration, the relatively simple construction and the reliable durable interconnection between the flyer bow and wire guide tube, at the same time along with the easier exchangeability of the wire guide tube.

A particular advantage of continuous wire guidance by a tube according to the present invention, as compared with discontinuous wire guidance by eyes or the like according to the prior art, is that the wire is loaded uniformly over the entire length. In conventional wire guidance by eyes, the wire lies on the individual eyes when the stranding machine is started up, before it is pressed onto the inner flank of the flyer bow due to centrifugal force during the stranding process. Owing to friction at the eyes, the wire is loaded to a greater extent at the points where it lies in each case on the eyes than in the regions located between the eyes. In the wire guidance according to the invention by use of a tube, when the machine is started up the wire lies over the entire length on that wall of the wire guide tube 7 which points toward the axis of rotation and is thereby loaded uniformly before it is in turn pressed, during the stranding process, by the centrifugal force onto the tube wall distant from the axis of rotation.

To manufacture the flyer bow according to the invention, in principle, all techniques suitable for the production of moldings from fiber-reinforced composite materials can be adopted. Preferably, those techniques allowing manufacture close to the final contour are employed. Thus, a better utilization of the relatively costly fiber-reinforced composite material can be achieved, as compared with material-removing shaping by fashioning the work piece out of a solid material block. Typical techniques known to a person skilled in the art are, inter alia, hand lamination, compression molding and resin transfer molding (RTM).

Figure 3:
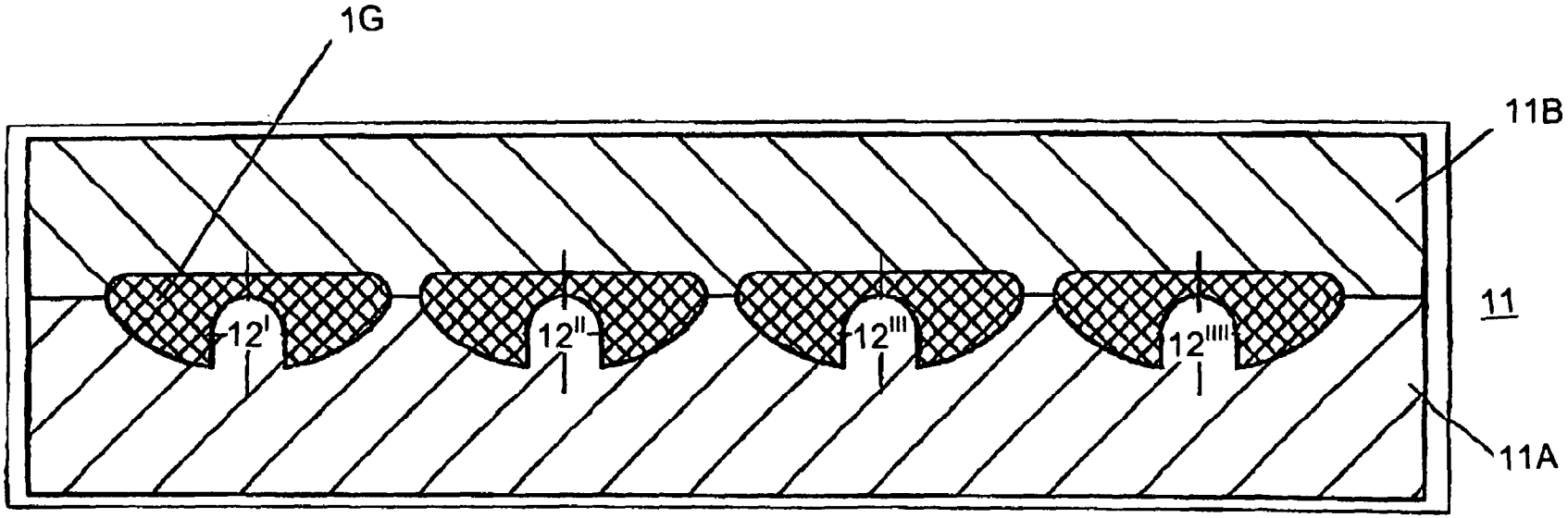
FIG. 3 is a diagrammatic, sectional view through a multiple forming die for the simultaneous production of a plurality of flyer bows.

Preferably, a multiple forming die 11 according to FIG. 3 is used, containing a lower die 11*a* with a plurality of cavities and with a corresponding press ram 11*b*, so that a plurality of flyer bows can be formed simultaneously by one pressing. The cavities exactly copy the contours of the flyer bow to be produced, so that manufacture close to the final contour takes place. In the die, illustrated by way of example in FIG. 3, for the production of flyer bows having the profile shown in FIG. 1G on the bottom of each cavity there is a bead 12', 12", 12''', 12'''', the cross section of which corresponds to the cross section of the groove on the inner flank of the flyer bow. These beads act as space savers for the grooves.

Alternatively, a more simple shaped die without the beads 12', 12", 12''', 12'''', with exchangeable inserts as space savers for the grooves, may also be used. Thus, by the inserts being changed, one die can be used for flyer bows having different groove geometries. The inserts may be manufactured from metal, for example aluminum, or from a plastic that is stable under the conditions of the shaping process and does not bond with the plastic matrix of the CFRP or GFRP of the flyer bow body. Furthermore, for example, a hose filled with compressed air and having a suitable diameter may be used as a space saver for the groove.

Finally, the wire guide tube itself may also be inserted into the die, so that the flyer bow is formed directly around the wire guide tube. In order to prevent the wire guide tube from being deformed in an undesirable way during the shaping process, the latter may likewise be stabilized by being filled with compressed air.

The abovementioned exemplary production methods are not restricted to a specific bow profile, but they may also be employed, for example, for flyer bows in the form of an airfoil and having wire guide tubes according to the invention. The cavities in the die must then be configured according to the desired bow profile.

This application claims the priority, under 35 U.S.C. § 119, of European patent application No. 04 015 191.2, filed Jun. 29, 2004; the entire disclosure of the prior application is herewith incorporated by reference.

We claim:

1. A flyer bow for a wire bunching or wire stranding machine, the flyer bow comprising:

a flyer bow, body having an inner flank; and a longitudinally runnifig wire guide tube formed of a wear-resistant material disposed centrally on said inner flank of said flyer bow body with respect to an axis of rotation.

2. The flyer bow according to claim 1, wherein said flyer bow body is formed of a plastic reinforced with a material selected from the group consisting of glass fibers1 carbon fibers, and a mixed composition of carbon fibers and glass fibers.

3. The flyer bow according to claim 1, wherein said wire guide tube is formed of a material selected from the group consisting of metal and plastic.

4. The flyer bow according to claim 1, wherein said wire guide tube is formed of a material selected from the group consisting of a plastically deformable material and an elastically deformable material.

5. The flyer bow according to claim 1, wherein said wire guide tube is a plastic hose.

6. The flyer bow according to claim 1, wherein said wire guide tube is formed of a transparent material.

7. The flyer bow according to claim 1, wherein said wireguide tube has an inside diameter of between 1.5 and 28 mm.

8. The flyer bow according to claim 1, wherein said flyer bow body has a profile in the form of an airfoil.

9. The flyer bow according to claim 1, wherein said flyer bow body has a profile in the form of a rectangle with rounded corners or of a flattened octagon.

10. The flyer bow according to claim 1, wherein said flyer bow body has a profile such that said inner flank with respect to the axis of rotation has a convex curvature and an outer flank that is flat, a transition region between said inner flank and said outer flank being rounded.

11. The flyer bow according to claim 1, wherein said inner flank has formed in it centrally, for receiving said wire guide tube, a longitudinal groove, said longitudinal groove having a width with an undersize with respect to outer dimensions of said wire guide tube to be introduced into said longitudinal groove.

12. The flyer bow according to claim 11, wherein said longitudinal groove has a U-shaped cross section.

13. The flyer bow according to claim 1, wherein:

said inner flank has formed therein centrally, for receiving said wire guide tube, a longitudinal groove defined by groove walls;

said longitudinal groove has a cross section in a form of a circle which is truncated by a chord resulting in a truncated circle;

said longitudinal groove has a diameter corresponding to an outside diameter of said wire guide tube to be inserted; and said truncated circle has an arc covering an angle of between 180 and 240°, and a straight truncation line forming an orifice of said longitudinal groove, so that said wire guide tube, after insertion, has engaged behind it said groove walls projecting toward said orifice.

14. The flyer bow according to claim 1, wherein said inner flank has a longitudinal groove formed centrally therein for receiving said wire guide tube.

15. The flyer bow according to claim 1, wherein said inner flank has a groove formed therein for removably receiving said wire guide tube.

16. The flyer bow according to claim 1, wherein said wire guide tube is a cylinder.

17. The flyer bow according to claim 1, wherein said wire guide tube is an unbroken cylinder.

18. The flyer bow according to claim 1, wherein said wire guide tube is separate from said flyer bow body.

* * * * *